US006747608B2

(12) United States Patent
Wu

(10) Patent No.: US 6,747,608 B2
(45) Date of Patent: Jun. 8, 2004

(54) HIGH PERFORMANCE MULTI-BAND FREQUENCY SELECTIVE REFLECTOR WITH EQUAL BEAM COVERAGE

(75) Inventor: Te-Kao Wu, Rancho Palos Verdes, CA (US)

(73) Assignee: Northrop Grumman Corporation, Redondo Beach, CA (US)

( * ) Notice: Subject to any disclaimer, the term of this patent is extended or adjusted under 35 U.S.C. 154(b) by 0 days.

(21) Appl. No.: 10/407,063

(22) Filed: Apr. 3, 2003

(65) Prior Publication Data

US 2003/0164803 A1 Sep. 4, 2003

Related U.S. Application Data

(62) Division of application No. 09/996,095, filed on Nov. 27, 2001.

(51) Int. Cl.[7] ..... H01Q 15/02
(52) U.S. Cl. ..... 343/909; 343/755; 343/781 R
(58) Field of Search ..... 343/909, 781 R, 343/782, 700 MS, 781 CA, 840, 754, 755; H01Q 15/12

(56) References Cited

U.S. PATENT DOCUMENTS 4,096,483 A 6/1978 Bui Hai et al. ..... 343/781 CA
4,319,250 A 3/1982 Takano et al. ..... 343/781 CA
4,335,387 A 6/1982 Salvat et al. ..... 343/756
6,054,967 A 4/2000 Wu et al. ..... 343/909
6,169,524 B1 1/2001 Wu et al. ..... 343/840
6,608,607 B2 * 8/2003 Wu ..... 343/909

* cited by examiner

*Primary Examiner*—Hoanganh Le
(74) *Attorney, Agent, or Firm*—Harness, Dickey & Pierce, P.L.C.

(57) ABSTRACT

A high performance multi-band antenna reflector having low sidelobe and cross polarization levels, and a superior carrier-to-interference ratio has two concentric zones (12, 14 in a first embodiment and 102, 104 in a second embodiment). In the first embodiment, the outer concentric zone (14) is a frequency selective absorber (20) made of a metallic pattern (22) dimensioned to reflect signals in one frequency band and absorb signals in a second frequency band. In the second embodiment, the outer concentric zone (104) is a frequency selective surface (106) that reflects signals in one frequency band and passes signals in a second frequency bands. Resistance cards (122) overlay the top and bottom sides of the junction between the frequency selective surface (106) and a reflective layer (110) on an inner surface (112) of the central concentric zone (102).

10 Claims, 6 Drawing Sheets

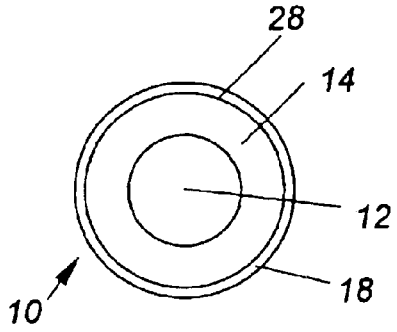
Figure 1a
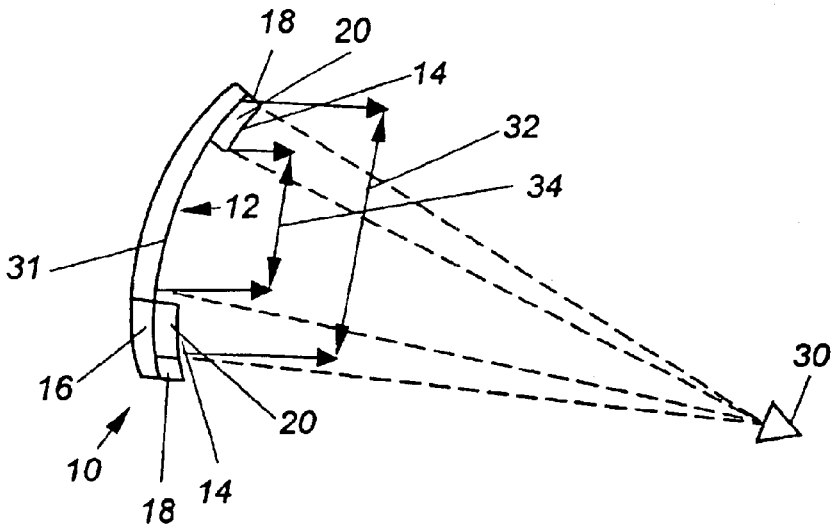
Figure 1b
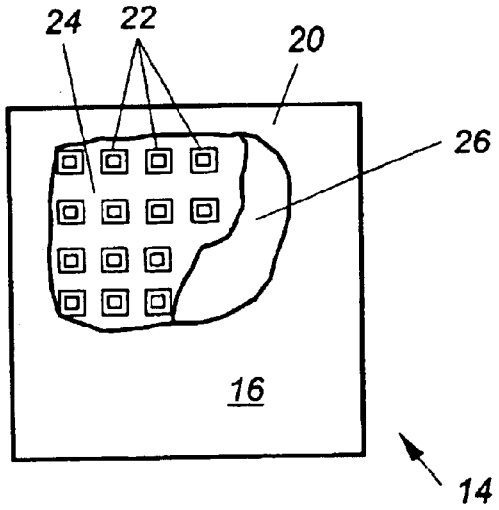
Figur 2

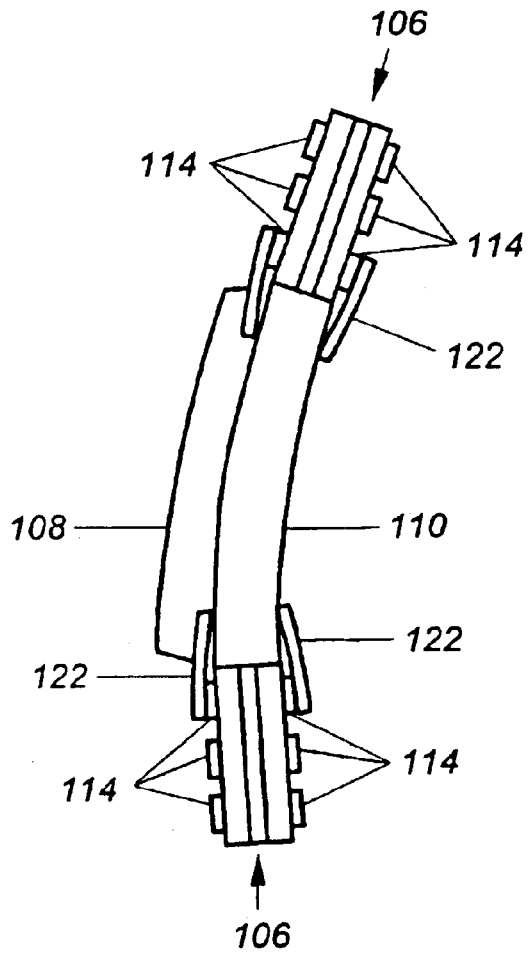
Figure 6
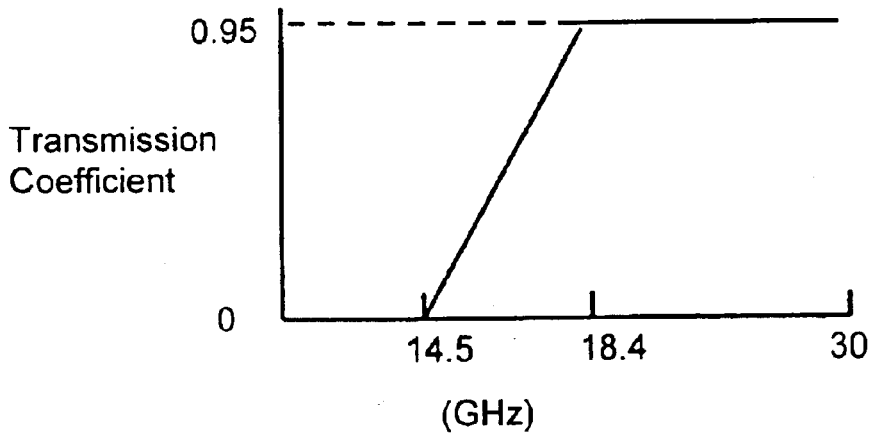
Figur 7

HIGH PERFORMANCE MULTI-BAND FREQUENCY SELECTIVE REFLECTOR WITH EQUAL BEAM COVERAGE

FIELD OF THE INVENTION

The present invention relates to reflector antennas, and more particularly, to multi-band antennas for spacecraft having frequency selective absorber surfaces or frequency selective surfaces

BACKGROUND OF THE INVENTION

Spacecraft, particularly satellite communication systems, use reflector antennas to transmit and to receive microwave frequency signals, typically, to and from land based communication stations. Advanced satellite communication systems typically require low mass, low volume, low cost, multi-band antennas. Examples of multi-band antennas where the same reflector is used for both uplink and downlink frequencies, which are different, are disclosed in U.S. Pat. No. 6,169,524 B1. The multi-band antennas disclosed in this patent utilize frequency selective or polarization sensitive zones to enable a single reflector to provide the plurality of antenna patterns for the different uplink and downlink frequencies.

Some applications require that different frequency bands have the same beamwidth or beam coverage cell size. In such applications, the antenna reflector for a multi-band antenna must provide the same cell size for the different frequency bands.

SUMMARY OF THE INVENTION

A multi-band antenna reflector for use with first and second different frequency bands to produce a comparable beam cell size for each frequency band with high performance, low sidelobe and cross polarization levels, and a superior carrier-to-interference ratio (C/I) in accordance with an embodiment of the invention has a concave reflector. The concave reflector has central and outer concentric zones. The central concentric zone reflects signals in the first and second frequency bands and the outer concentric zone is configured as a frequency selective absorber that reflects signals in the first frequency band and absorbs signals in the second frequency band. The frequency selective absorber has a finite conducting pattern or lossy element pattern dimensioned to reflect signals in the first frequency band with a predetermined equivalent reactance value and absorb the signals in the second frequency band with a predetermined sheet resistance (ohms/square) and absorber rings disposed at the periphery of the outer concentric zone.

A multi-band antenna reflector for use with first and second different frequency bands to produce a comparable beam cell size for each frequency band with high performance, low sidelobe and cross polarization levels, and a superior carrier-to-interference ratio (C/I) in accordance with another embodiment of the invention has central and outer concentric zones. The central concentric zone has a reflective layer on an inner surface that reflects signals in the first and second frequency bands. The outer concentric zone is a frequency selective surface formed of a dielectric core having a finite conducting pattern on top and bottom sides. The conductive pattern is dimensioned to reflect signals in the first frequency band and pass signals in the second frequency band. Resistance cards overlay the top and bottom of the junction between the reflective layer of the central zone and the frequency selective surface of the outer zone.

In an embodiment of the invention, dual frequency feeds transmit signals in the first and second frequency bands to the concentric zones.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

FIG. 1*a* is a top plan view of a multi-band antenna reflector in accordance with an embodiment of the invention;

FIG. 1*b* is a side plan view of the multi-band antenna reflector of FIG. 1*a;*

FIG. 2 is top view, partially broken away, of a frequency selective absorber of the multi-band antenna reflector of FIG. 1;

FIG. 6 is a side view of a junction between a conductive layer of a central zone and the frequency selective surface outer zone of the multi-band antenna of FIG. 4*a;*

FIG. 7 is a graph showing the specified transmission coefficient of the frequency selective surface of the multi-band antenna reflector of FIG. 4*a;*

DETAILED DESCRIPTION OF THE PREFERRED EMBODIMENTS

Figure 3:
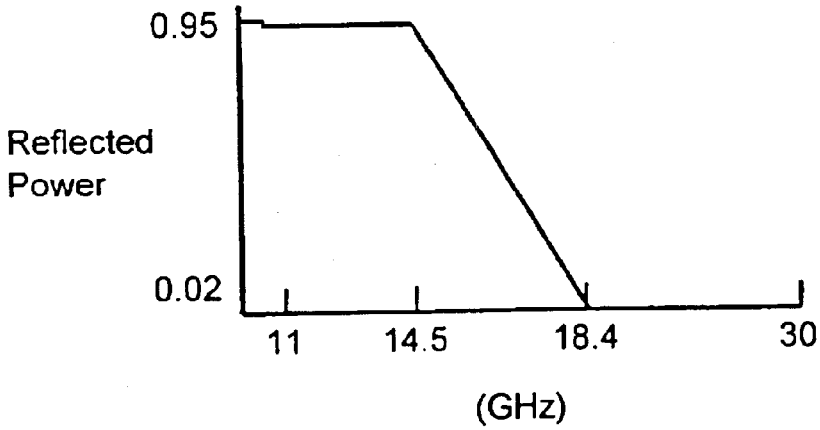
FIG. 3 is a graph showing specified reflected power of the frequency selective absorber of the multi-band antenna reflector of FIG. 1.

The following description of the preferred embodiment(s) is merely exemplary in nature and is in no way intended to limit the invention, its application, or uses.

Referring to FIGS. 1*a* and 1*b*, an embodiment of the invention utilizing a frequency selective absorber 20 is shown that provides comparable beam coverage cell size for two frequency bands, such as the Ku frequency band (10.95–14.5 GHz) and Ka frequency band (18.2–30 GHz) with high performance, low sidelobe and crosspolarization levels, and a superior C/I ratio (for example, better than 17 dB). A concave reflector 10, illustratively a parabolic reflector, has a two concentric zones, a central zone 12 and an outer concentric zone 14. Central zone 12 is configured to reflect both Ku and Ka band signals while outer zone 14 is formed as a frequency selective absorber that reflects only Ku band signals and absorbs Ka band signals. Reflector 10 has a lightweight core 16, preferably formed of a material reflective at the Ku and Ka bands, preferably graphite. If lightweight core 16 is formed of a material that is not reflective of the Ku and Ka bands, then a reflective coating must be applied to an inner or active surface 31 of at least the central zone 12 portion of lightweight core 16.

Referring to FIGS. 1*b* and 2, outer zone 14 is a frequency selective absorber 20 comprising a finite conducting pattern or lossy element pattern 22, illustratively a metallic pattern, on a substrate film 24, such as teflon. The pattern 22 and substrate film 24 are affixed in spaced relationship to the lightweight core 16 of reflector 10, such as by spacers 26. The total thickness of substrate film 24 and spacers 26 should be approximately one-quarter wavelength at the Ka band. Spacers 26 can illustratively be a frame structure or a layer of foam such as Rohacell™ foam. Rohacell™ foam is fabricated by Richmond Corporation located in Norwalk, Calif. A ring 18 of taper shaped absorber may be added to an outer periphery 28 of outer zone 14 and to the boundary between inner zone 12 and outer zone 14. The absorptive material used for the absorber rings is an absorptive material that is absorptive at Ka band frequencies, such as an Eccosorb® absorber that is absorptive at Ka band frequencies, for example, Eccosorb® AN-72. Eccosorb® absorbers are manufactured by Emerson & Cuming located in Canton, Mass. A resistance card, such as resistance card 122 discussed below, can also be applied to the boundary between inner zone 12 and outer zone 14 and to the boundary between outer zone 14 and outer periphery 28.

Pattern 22 is preferably a pattern of resonant lossy square loops to provide sharp roll-off. Pattern 22 is dimensioned to reflect signals in the Ku band with a predetermined equivalent reactance value and absorb signals in the Ka band with a predetermined sheet resistance (ohms/square). FIG. 3 is a graph showing the specified reflected power of zone 14.

While resonant square loops are preferably used for pattern 22, it should be understood that other configurations for pattern 22 can be used, such as dipole, tripole or cross. Various configurations that can be used for pattern 22 are disclosed in U.S. Pat. Nos. 6,169,524 and 6,054,967, which are herein incorporated by reference.

For use with the Ku and Ka band frequencies, reflector 10 has a diameter of sixty-seven inches with the diameter of zone 12 being 38.3 inches and the width of zone 14 being 14.3 inches. While reflector 10 is described in the context of use with the Ku and Ka band frequencies, it should be understood that its use is not limited to these frequency bands and that it can be used for other frequency bands with appropriate dimensional changes as would be appreciated by one skilled in the art.

Illustratively describing the operation of reflector 10 in the context of a downlink, dual frequency feeds 30 transmit Ku band and Ka band signals toward reflector 10. Ku band signals 32 are reflected by both zones 12 and 14 of reflector 10. Ka band signals 34 are reflected by central zone 12 and absorbed by outer zone 14. Reflector 10 reflects both the Ka band signals and the Ku band signals with the same beam cell size, illustratively, one degree. Dual frequency feeds 30 can illustratively be the dual-band feed horn disclosed in U.S. Ser. No. 09/941,413 for a Dual-Band Equal-Beam Reflector Antenna System filed Aug. 28, 2001, which is incorporated by reference herein.

Figure 4A:
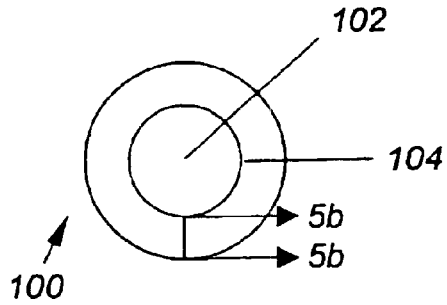
FIG. 4*a* a top plan view of a multi-band antenna reflector in accordance with an embodiment of the invention.
Figure 4B:
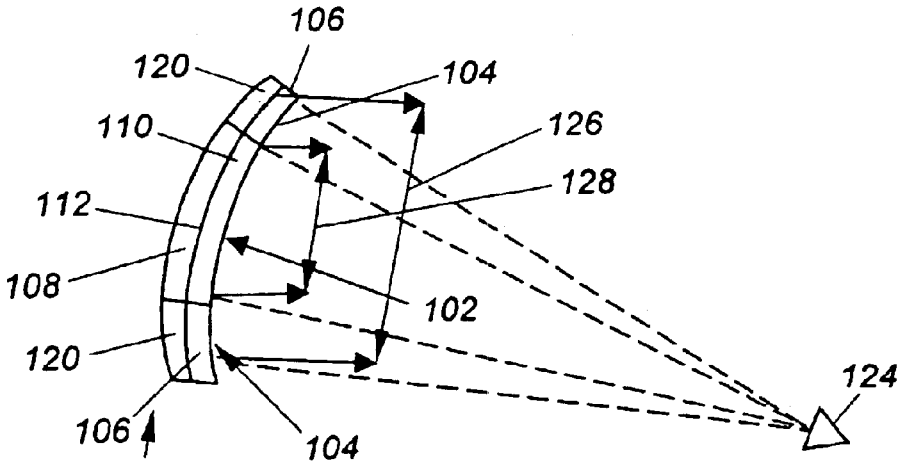
FIG. 4*b* is a side plan view of the multi-band antenna reflector of FIG. 4*a;*

Turning to FIGS. 4*a* and 4*b*, an embodiment of the invention utilizing a frequency selective surface 106 is shown. A reflector 100, illustratively a parabolic reflector, has two concentric zones, a central zone 102 and an outer concentric zone 104. Central zone 102 is configured to reflect both Ku and Ka band signals while outer zone 104 has a frequency selective surface 106 that reflects only Ku band signals and passes Ka band signals. Central zone 102 illustratively includes a support core 108 having a reflective layer 110 on an inner surface 112, such as support core 108 having a metallized surface, that is reflective at the Ku and Ka bands.

Figure 5A:
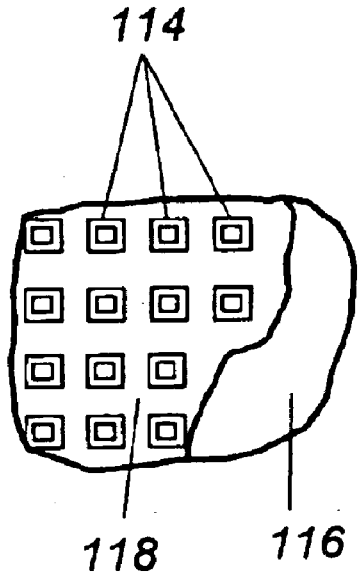
FIG. 5*a* is top view, partially broken away, of a frequency selective surface of the multi-band antenna reflector of FIG. 4*a;*
Figure 5B:
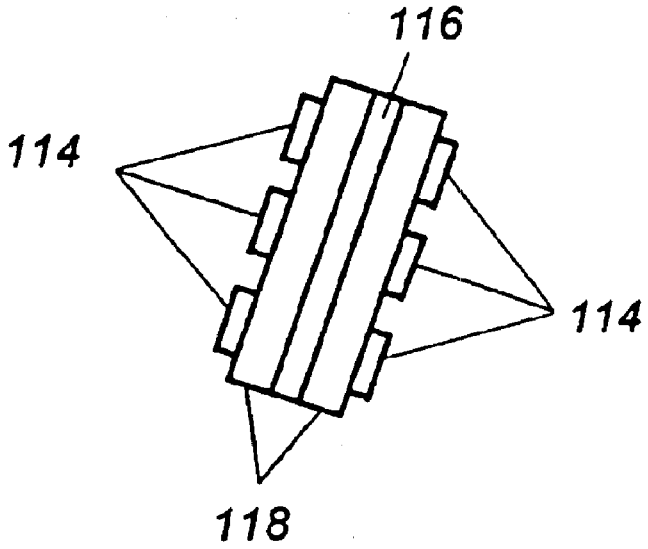
FIG. 5*b* is a section view of a frequency selective surface of the multi-band antenna reflector of FIG. 4*a* taken along the line 5*b*—5*b;*

Zone 104 comprises frequency selective surface 106 that is reflective at the Ku band and transparent at the Ka band. Referring to FIGS. 4*b*, 5*a* and 5*b*, zone 104 is comprised of a finite conducting pattern 114, illustratively a metallic pattern, over both top and bottom sides of a dielectric core 116. The top and bottom patterns 114 are illustratively formed on a substrate film 118, such as teflon, which is then bonded to the top and bottom sides of dielectric core 116. Dielectric core 116 is fabricated from materials such as Kevlar™, Nomex™, ceramic foam, Rohacell™ foam, or the like which are known in the art to pass microwave signals. Kevlar™ and Nomex™ are fabricated by Hexcel Corporation located in Huntington Beach, Calif. Conductive patterns 114 are dimensioned so that Ku band signals are reflected while Ka band signals are passed through. In this regard, a layer 120 of absorptive material can be disposed on the back side of frequency selective surface 106 to absorb the Ka band signals. The absorptive material can be the above referenced Eccosorb® AN-72 absorber.

Resistance cards 122 (FIG. 6) are applied to the top and bottom of all junctions between the frequency selective surface 106 and the reflective surface 110 of zone 102 of reflector 100. Resistance cards are known in the art and comprise a thin membrane onto which a thin, graded low density layer of copper is deposited. The resistance of the resistance card is determined by the density of the copper. A resistance card that could be utilized for resistance cards 112 is the R-card™ manufactured by Southwall Technologies located in Palo Alto, Calif.

For use with Ka and Ku band frequencies, the diameter of reflector 100 is 67 inches with the diameter of central zone 102 being 38.3 inches and the width of outer zone 104 being 14.3 inches. While reflector 100 is again described in the context of use with Ku and Ka band frequencies, it should be understood that its use is not limited to these frequency bands and it can be used for other frequency bands with appropriate dimensional changes as would be appreciated by one skilled in the art.

FIG. 7 is a graph showing the specified transmission coefficient of zone 104 using resonant square loops for conductive patterns 114. It should be understood that while resonant square loops are preferred for conductive patterns 114 to provide for sharp roll-off, other configurations can be used, such as dipole, tripole or cross. Various configurations that can be used for conductive patterns 114 are disclosed in the above referenced U.S. Pat. Nos. 6,169,524 and 6,054,967.

Illustratively describing the operation of reflector 100 in the context of a downlink, dual frequency feeds 124 transmit Ku and Ka band signals toward reflector 100. Ku band signals 126 are reflected by both zones 102 and 104 of reflector 100. Ka band signals 128 are reflected by zone 102 and pass through zone 14. Reflector 100 reflects both the Ka band signals and the Ku band signals with the same beam cell size, illustratively, one degree. Dual frequency feeds 124 can illustratively be the dual-band feed horn disclosed in the above referenced U.S. Ser. No. 09/941,413 for a Dual-Band Equal-Beam Reflector Antenna System.

Figure 8:
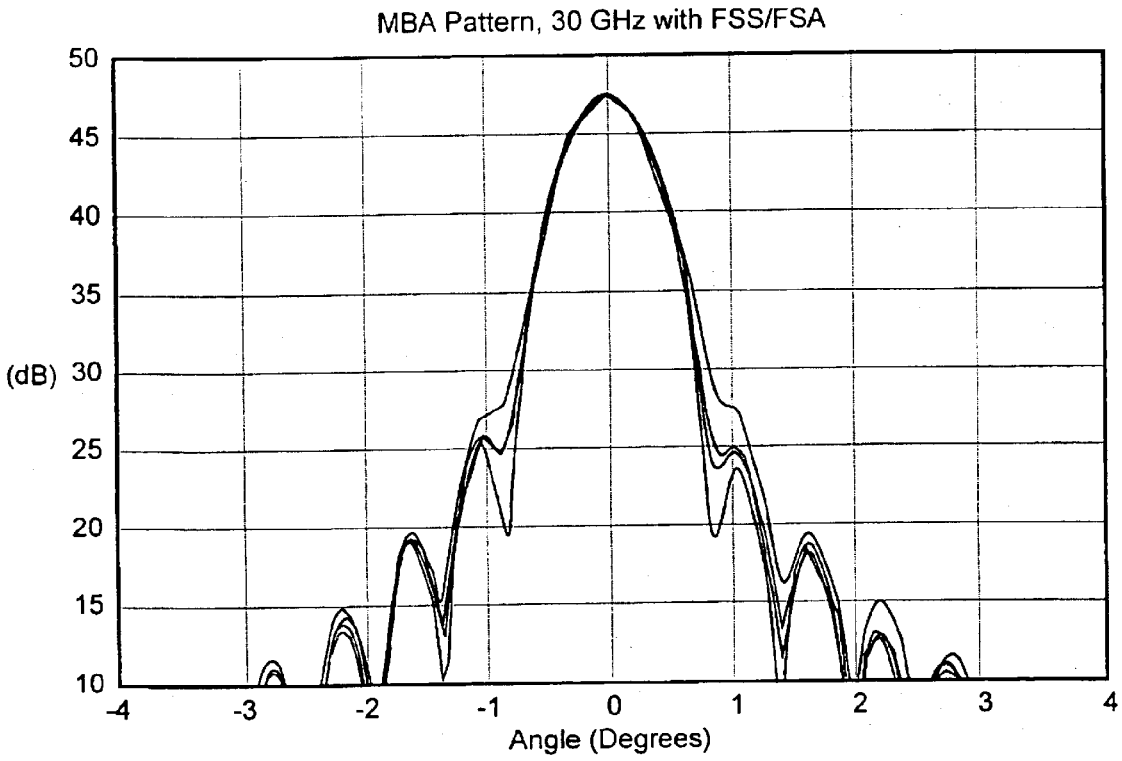
FIG. 8 is a graph showing predicted radiation patterns at 30 GHz for the multi-band antenna reflectors of FIGS. 1*a* and 4*a*.

FIG. 8 is a graph that shows the predicted radiation patterns at 30 GHz for the frequency selective absorber and the frequency selective surface embodiments of the invention described above.

Figure 9:
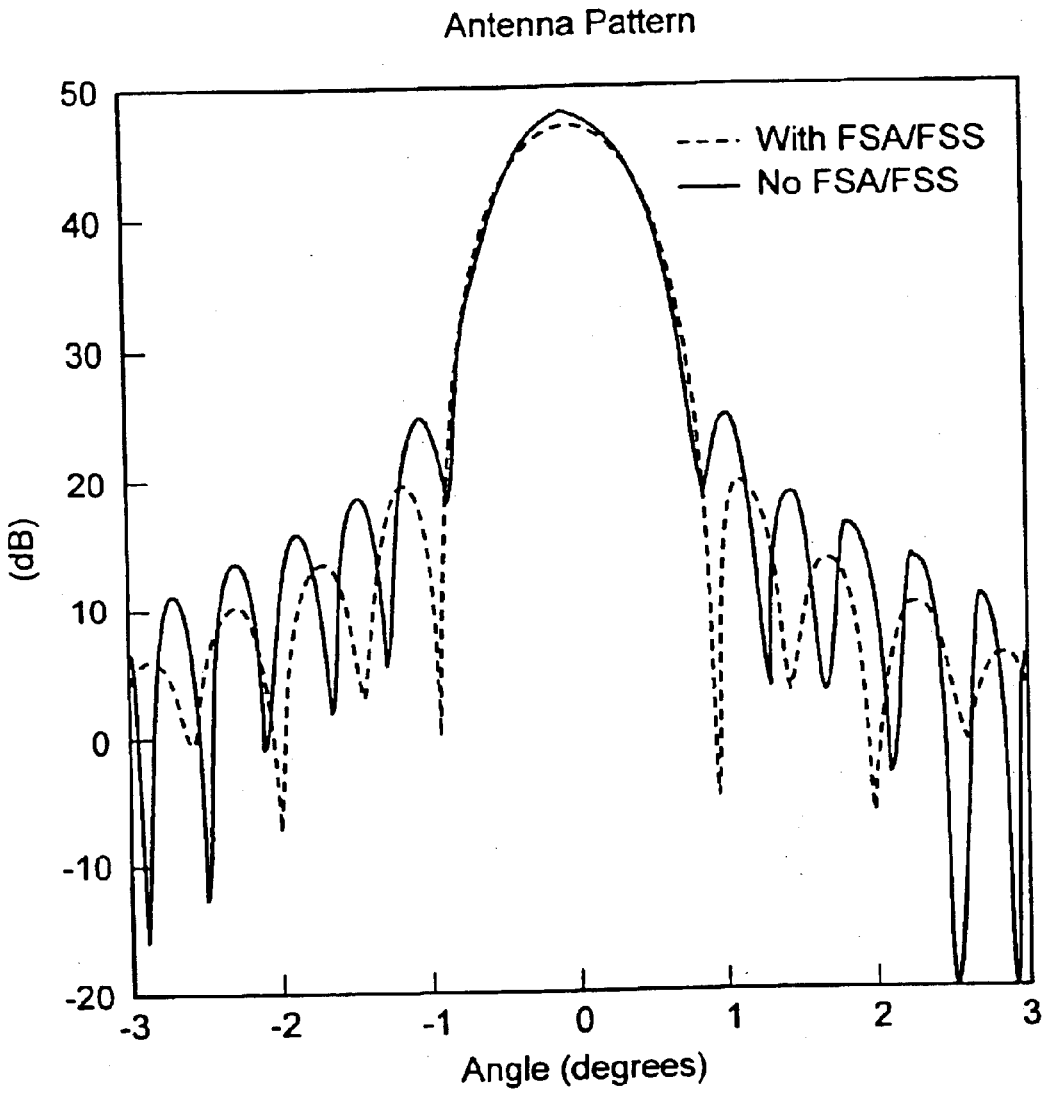
FIG. 9 is a graph comparing the radiation patterns of a reflector in accordance with FIGS. 1*a* and 4*a* with a reflector that has neither a frequency selective absorber or a frequency selective surface.

FIG. 9 is a graph comparing the radiation patterns for a reflector in accordance with either the frequency selective absorber embodiment or the frequency selective surface embodiment of the invention to a reflector that has neither a frequency selective absorber or a frequency selective surface. As can been seen from FIG. 9, a reflector in accordance with either the frequency selective absorber embodiment or frequency selective surface embodiment of the invention has the same edge of coverage gain for a cell size of 0.5 degree radius as a reflector without a frequency selective absorber or frequency selective surface, but has lower sidelobe levels.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A high performance multi-band antenna reflector for use with signals in a plurality of different frequency bands and producing a comparable beam cell size for each of the plurality of frequency bands, comprising:

a concave reflector having a plurality of concentric zones with one zone for each of the plurality frequency bands, the plurality of concentric zones including a central zone and at least one outer zone;

the at least one outer zone configured as a frequency selective absorber to reflect signals in a Ku frequency band and absorb signals in a Ku frequency band;

the frequency selective absorber comprising a pattern of resonant lossy square loops dimensioned to reflect the signals in the Ku frequency band and absorb the signals in the Ku frequency band.

2. The multi-band antenna reflector of claim 1 and further including a ring of absorber disposed around at least one of an outer periphery of the at least one outer zone and a boundary between the zones.

3. The multi-band antenna reflector of claim 1 wherein the pattern is dimensioned to reflect signals in the Ku frequency band with a predetermined equivalent reactance value and absorb signals in the Ku frequency band with a predetermined sheet resistance (ohms/square).

4. The multi-band antenna reflector of claim 1, wherein the central concentric zone reflects the signals in the Ku and Ks frequency bands.

5. A high performance multi-band antenna relflector for use with Ku and Ka frequency bands to produce a comparable beam cell size for each frequency band, comprising a concave reflector having central and outer concentric zones, the central concentric zone reflecting signals in the Ku and Ka frequency bands and the outer concentric zone configured as a frequency selective absorber that reflects signals in the Ku frequency band and absorbs signals in the Ka frequency band;

the frequency selective absorber having a pattern of resonant lossy square loops dimensioned to reflect signals in the Ku frequency band and absorb signals in the Ka frequency band.

6. The multi-band antenna reflector of claim 5 and further including a ring of absorber disposed around at least one of an outer periphery of the outer concentric zone and a boundary between the zone.

7. The multi-band antenna reflector of claim 5 wherein the pattern is dimensioned to reflect signals in the Ku frequency band with a predetermined equivalent reactance value and absorb signals in the Ka frequency band with a predetermined sheet resistance (ohms/square).

8. The multi-band antenna reflector of claim 5, wherein the concave reflector is a parabolic reflector.

9. The multi-band antenna reflector of claim 8, wherein the concave reflector has a diameter of approximately 67 inches, the central concentric zone has a diameter of approximately 38.3 inches, and the pattern comprises a metallic pattern.

10. The multi-band antenna reflector of claim 5, and further including dual frequency feeds for transmitting signals in the Ku and Ka frequency bands toward the concave reflector.

* * * * *